United States Patent [19]

Matono

[11] 4,137,927

[45] Feb. 6, 1979

[54] COIN STACKING TUBE DEVICE

[75] Inventor: Hirokuni Matono, Himeji, Japan

[73] Assignee: Glory Kogyo Kabushiki Kaisha, Japan

[21] Appl. No.: 752,960

[22] Filed: Dec. 20, 1976

[30] Foreign Application Priority Data

Dec. 22, 1975 [JP] Japan ..... 50-151845

[51] Int. Cl.[2] ..... G07D 9/06

[52] U.S. Cl. ..... 133/1 A; 53/212

[58] Field of Search ..... 133/1 R, 1 A, 8 R, 8 A; 221/242; 53/212

[56] References Cited

FOREIGN PATENT DOCUMENTS 1321209 6/1973 United Kingdom ..... 133/1 A

*Primary Examiner*—Stanley H. Tollberg
*Assistant Examiner*—Francis J. Bartuska
*Attorney, Agent, or Firm*—Beveridge, De Grandi, Kline & Lunsford

[57] ABSTRACT

A coin stacking tube device to be incorporated in a coin wrapping apparatus comprises an outer casing, a plurality of blades within the outer casing, an operative member to set the tube device selectively, for a desired denomination of coins, and a spring member urging the blades inwardly. Each of the blades is loosely supported by the outer casing to be rotatable around one axis and by the operative member to be rotatable around another axis.

3 Claims, 3 Drawing Figures

COIN STACKING TUBE DEVICE

BACKGROUND OF THE INVENTION

This invention relates generally to coin handling and processing apparatus such as coin wrapping apparatus and more particularly to a coin stacking tube device suitable for incorporation in any of such apparatus.

A typical example of a conventional coin wrapping apparatus is that of a construction wherein coins supplied from a hopper onto a turntable are arrayed by centrifugal force applied thereto along the periphery of the turntable, and a coin counting mechanism counts the coins while the coins are sent from the turntable to a coin passage and propelled therealong by, for instance, a propelling belt. The coins delivered from the coin passage one after another are received in a coin stacking tube to be stacked therein, the coins thus stacked being dropped into a coin wrapping device comprising a plurality of coin wrapping rolls disposed around a circle directly below the coin stacking tube. The thus stacked coins are wrapped by the wrapping rolls with a piece of paper, and the lateral edges of the paper are fold crimped to form firm beads by which the paper is maintained in tightly wrapped state.

In the case when it is required to change the denomination of coins to be wrapped in the coin wrapping apparatus, various parts of the apparatus must be readjusted so that the apparatus is set for the new denomination of coins. Of these parts, the number of coins supplied onto the turntable, the rotating speed of the same, the lateral width of the coin passage, the height and the position of the propelling belt, the positions of the wrapping rolls to be brought into contact with the stack of coins, and the rotating speed of the wrapping rolls can be readjusted comparatively easily by interlinking those members controlling these values with a member for setting the apparatus to a different denominations of coins.

However, the adjustment of the inner diameter of the coin stacking tube is not easy, and therefore it has been a conventional practice to prepare a number of coin stacking tubes each having a different inner diameter suitable for a specific denomination (or one outer diameter) of coins and, at the time of changing the denomination of coins to be wrapped, to replace the existing coin stacking tube with another suitable for the new denomination.

In this case also, the denomination changing operation is found to be troublesome because of the requirement of the selection and the replacement, and furthermore there has been a high possibility of erroneous selection of the coin stacking tube, causing unsatisfactory stacking of coins in the erroneous coin stacking tube.

Recently, a type of coin stacking tube whose inner diameter is made variable in accordance with the denomination of coins has been developed. In this kind of coin stacking tube, the space for receiving the coins is formed by a plurality of blades provided in an outer casing, the inner edge of each blace contacting against the inner surface of the preceding blade, the stem part of each blade being supported rotatably about an axis fixed to the outer casing, and all blades being rotated in either of the opening and closing directions in accordance with the denomination setting in the coin wrapping apparatus, whereby the space formed within the plurality of blades is adapted for the denomination or the outer diameter of the coins to be stacked therein.

In this example, however, in order to assure smooth rotation of the blades at the time of expension or constraction of the interior space of the coin stacking tube, the rotating axes for the blades must be secured to the outer casing in parallel with each other. If the rotating axes are not accurately, parallel, the coin stacking space formed therein cannot be of a correct circular cross-section, thus causing unsatisfactory stacking of coins within the tube, and the uneven contacting of the innermost edges of the blades against the inner surfaces of the preceding blades causing a considerable torque to be required for rotating the blades.

SUMMARY OF THE INVENTION

With the above described difficulties of the conventional coin stacking tube in view, a principal object of the present invention is to provide a coin stacking tube device of a simple construction, which can substantially eliminate the above described difficulties.

Another object of the invention is to provide a coin stacking tube device which can be adapted to various denomination of coins in a short time by a comparatively small controlling force.

Still another object of the present invention is to provide a coin stacking tube device including a plurality of rotatable blades wherein no precision alignment of the rotating axes is required.

According to the present invention, there is provided a coin stacking tube device comprising an outer casing, a plurality of blades provided within the outer casing, an operative member rotatable in accordance with a desired denomination of coins, each of the blades being rotatably supported at one position by the outer casing and at another position by the operative member, and spring means urging the blades inwardly until the innermost edge of each blade contacts against the inner surface of the preceding blade.

With the above described construction of the coin stacking tube device, since the innermost ends of the blades are brought into contact against the inner surfaces of the preceding blades by equal pressing force, a quasicircular space can be easily formed between the inner parts of the blades, and coins can be received smoothly and stacked promptly within the space formed by the blades. Furthermore, the coin stacking tube of the above described construction requires only a slight force for varying the positions of the blades in the resetting of the tube device for another denomination of coins.

The nature, principle, and utility of the present invention will be more fully understood from the following detailed description of the invention when read in conjunction with the accompanying drawings, wherein like parts are designated by like reference numerals.

DETAILED DESCRIPTION

Figure 1:
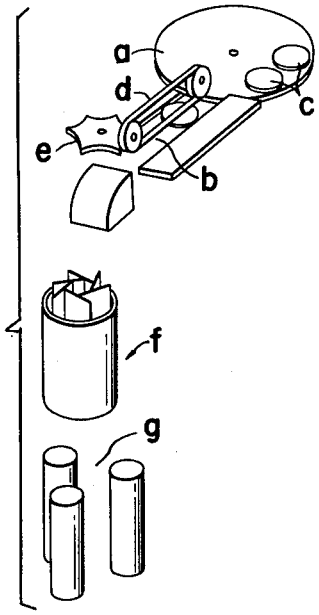
FIG. 1 is a schematic perspective view showing the general arrangement of only essential parts of one example of a coin wrapping apparatus.

Referring first to FIG. 1, there is illustrated the general construction of a coin wrapping apparatus wherein a coin stacking tube device of this invention is incorporated.

Coins of a specific denomination supplied by a hopper (not shown) onto a turntable a are arrayed along the periphery of the turntable a by centrifugal force, and then these coins c are sent out from the turntable a into a coin passage b and propelled along the passage b by a propelling belt d, the coins being counted by a counting mechanism e.

A predetermined number of coins c thus counted are then sent out successively from the coin passage b into a coin stacking tube f to be arranged therein into a stack of coins of a predetermined number and denomination. The stack of coins is then lowered into a coin wrapping part g of the apparatus comprising a plurality of wrapping rolls arranged in a circle directly below the coin stacking tube f and is wrapped by these wrapping rolls with a piece of wrapping paper, the lateral side edges thereof being fold crimped by crimping hooks (not shown), whereby the stack of coins is held in the tightly wrapped state.

As described hereinbefore, a difficulty has been posed by the coin stacking tube f in the case where the denomination of the coins to be wrapped by the coin wrapping apparatus is to be changed.

A coin stacking tube device according to the present invention, for incorporation in apparatus such as a coin wrapping apparatus, will now be described with reference to FIGS. 2 and 3. The device generally designated by reference numeral 1 comprises an outer casing 2 of a hollow cylindrical shape, a plurality of blades 3 disposed within the outer casing 2 in parallel with its central axis, an operative member 4 for displacing the plurality of blades 3 simultaneously, and spring means 5 urging the blades 3 inwardly.

The blades 3 have inner surface part 3*a* forming in combination a coin stacking space, and outer support parts 3*b* supported rotatably and in loose engagement by the outer casing 2, disposed outwardly from the inner surface parts 3*a*. The support part 3*b* of each blade is formed into a channel shape with a part of the blade folded back in parallel with the remaining part thereof.

At the bottom of the cylindrical outer casing 2, there is provided integrally therewith an annular flange 7 secured at its outer periphery to the inner surface of the outer casing 2. Upwardly projecting support pins 8 of a number equal to that of the blades 3 are arranged at equal spacing intervals on the annular flange 7 along a circle concentric with the outer casing 2.

The outer casing 2 has an upper supporting member 9 detachably and coaxially combined therewith, and at the bottom of the upper supporting member 9, there is provided integral therwith another annular flange 10 secured at its outer periphery to the inner surface of the supporting member 9. Downwardly projecting support pins 11 of a number equal to that of the blades 3 are arranged at equal spacing intervals on the lower surface of the annular flange 10 around a circle concentric with the outer casing 2. The upwardly projecting support pins 8 on the annular flange 7 at the bottom of the outer casing 2 and the downwardly projecting support pins 11 on the annular flange 10 of the supporting member 9 are respectively aligned with each other in the axial direction of the outer casing 2, and are loosely inserted in the lower and upper ends of the channel-shaped outer support parts 3*b* of the blades 3 for supporting the blades 3 rotatably around the respective vertically aligned support pins 8 and 11.

The upper and lower ends of the inner surface parts 3*a* of the blade 3 are respectively extended upwardly and downwardly by appropriate lengths beyond the upper and lower ends of the outer channel-shaped support parts 3*b* and are passed upwardly and downwardly through the central holes of the annular flanges 10 and 7 at the bottoms of the upper supporting member 9 and the outer casing main body 2.

On the upper surface of the annular flange 10 of the upper supporting member 9, an operative member 4 is rotatably mounted. The operative member 4 has an operative arm 12 projecting outwardly through a window 13 provided through the peripheral wall of the supporting member 9 over a certain necessary circumferential length at a position just above the annular flange 10. The operative arm 12 is coupled with a denomination setting mechanism (not shown) of the coin wrapping apparatus.

The operative member 4 has a central hole 14 for passing the upper ends of the inner surface parts 3*a* of the blades 3. The inner edge defining the central hole 14 of the operative member 4 is cut out into a configuration not disturbing the movements of the blades for expansion or contraction of the coin stacking space formed between the blades. More specifically, the peripheral edge of the hole 14 has inwardly projecting parts of a number equal to that of the blades, and downwardly projecting adjusting pins 15 are provided on the inwardly projecting parts of the peripheral edge of the hole 14, respectively, so that these are arranged in an equally spaced apart relationship along a circle concentric with the outer casing 2 and having a diameter smaller than that of the circles around which the pins 8 and 11 are arranged with equal spacing. Each of the downwardly projecting adjusting pins 15 is thus inserted into the channel-shaped outer support part 3*b* of a respective one of the blades 3 at a position inward from the position supported by the support pins 8 and 11.

Figure 3:
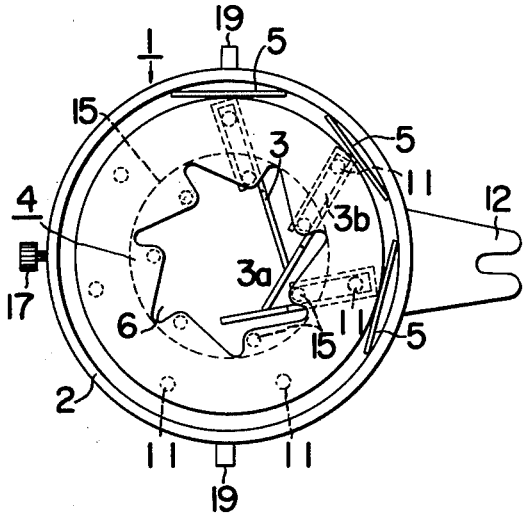
FIG. 3 is a plan view of the example of the coin tacking tube device shown in FIG. 2.

Longitudinally along the internal surface of the outer casing 2, leaf spings 5 of a number corresponding to that of the blades 3 are provided in a manner such that each of the leaf springs 5 is abutted by the outer edge of the outer support part 3*b* of a respective one of the blades 3 as shown in FIG. 3 and thus urges the blade 3 inwardly.

With the above described construction of the coin stacking tube device of this invention, the cross-sectional orientation of each blade 3 is determined by the adjusting pin 15 projecting downwardly from the operative member 4, and also by the adjusting pins 8 and 11 projecting from the support annular flanges 7 and 10 of the outer casing 2 and the supporting member 9, respectively, into the channel shaped support part 3*b* of that blade. Thus, the innermost edge of each blade 3 is brought into abutment by the leaf spring 5 against the inner surface of an adjacent blade 3, so that a quasicircular coin stacking space 6 is formed by the inner surface parts 3*a* of the succeeding blades 3.

Figure 2:
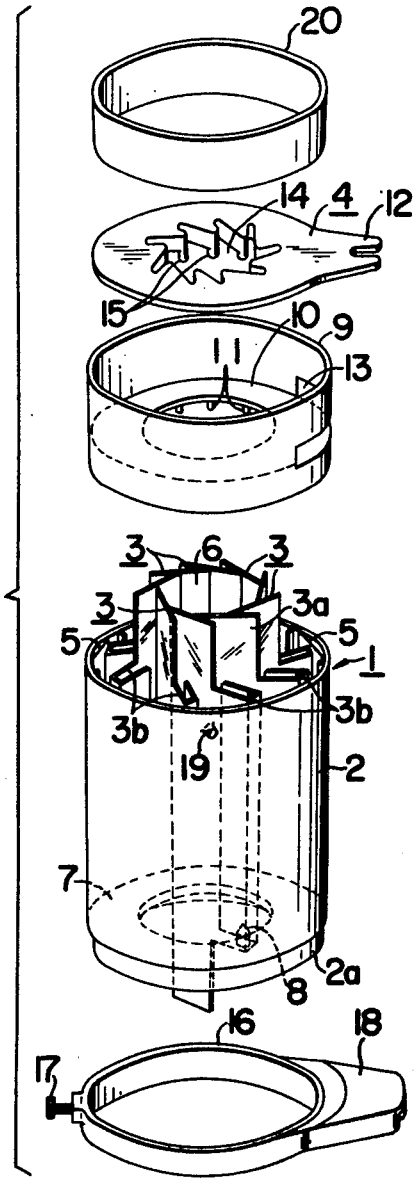
FIG. 2 is an exploded perspective view showing an example of a coin stacking tube device according to the present invention.

Reference numeral 16 in FIG. 2 designates a member used for coupling the coin stacking tube device 1 to a vibrator (not shown) so that a vibration is applied to the coin stacking tube, whereby the coins introduced in the coin stacking space 6 therein are stacked in neat form in a short period. The member 16 is secured by a set-screw 17 to a part 2*a* having a reduced diameter of the outer casing 2 at the lower end thereof, and a projecting part 18 of the member 16 is coupled to the vibrator (not shown) and vibrated in a horizontal direction as viewed in FIG. 2. A pin 19 is also provided on the outer surface of the outer casing 2 to be coupled with the vibrator to be thereby vibrated in a vertical direction. An annular member 20 is inserted in the supporting member 9 to keep the operative member 4 in its position.

Since the coin stacking tube device according to this invention is of the above described construction, the denomination setting operation of the denomination setting device (not shown) coupled to the operative arm 12 of the operative member 4 causes the operative arm 12 to rotate in one direction together with the adjusting pins 15 implanted on the lower surface of the operative member 4. Thus, the blades 3, each having the channel-shaped support part 3*b* receiving the corresponding pin 15 and also the support pins 8 and 11 projecting from the outer casing 2 and the supporting member 9, respectively, are rotated around the support pins 8 and 11, and the innermost edges of the blades 3 are caused to abut against the inner surface of the respectively preceding blades 3 by a compressive force imparted by the leaf springs.

Thus, any displacement within the allowable error of the pins and the like can be absorbed by the loose engagement between these pins and the channel-shaped support part 3*b* of each blade 3. Therefore, the blades 3 can be stably held in their positions regardless of slight deviations in the positions of the support pins 8, 11, and adjusting the pins 15 within the channel-shaped support parts 3*b*.

More specifically, when the operative member 4 is rotated in the clockwise direction as viewed in FIG. 3, the adjusting pins 15 projecting downwardly from the operative member 4 press against the support parts 3*b* so that the blades 3 are rotated simultaneously in the counterclockwise direction around the support pins 8 and 11 supported by the outer casing 2 and the support member 9. Thus, the points at which the innermost edges of the blades 3 abut against the inner surfaces of the preceding blades 3 retract outwardly, thereby increasing the inner diameter of the coin stacking space 6 formed within the blades 3.

When the operative member 4 is rotated in the counterclockwise direction in FIG. 3, the blades 3 are rotated simultaneously in the clockwise direction, and the inner diameter of the stacking space 6 is thereby reduced. Accordingly, by rotating the operative member 4 in accordance with the denomination of coins, a coin stacking space 6 having an inner diameter suitable for that denomination of the coins can be obtained.

Although leaf springs 5 are arranged outwardly of the blades 3 in the above described example of the invention, the leaf springs may be replaced by a single ring spring surrounding the outer ends of all blades 3 for urging the same inwardly.

I claim:

1. A coin stacking tube device comprising a first support flange; a plurality of parallelly-directed first support pins extending from said first support flange; a second support flange; a like plurality of parallelly-directed second support pins extending from said second support flange toward said first support pins; a like plurality of blades, each blade having a first blade end and a second blade end, said blades being supported on the first blade ends by said first support pins and on the second blade ends by said second support pins so that said blades are slidable on said support pins in a direction transverse the direction of said support pins and are pivotal about said support pins to cause one edge of each blade to overlap onto an adjacent blade to form a tube wall defining internally a continuous cylindrical space of polygonal cross-section for stacking therein a predetermined number of coins, said blades being pivotable about said support pins to permit adjustment of the internal cross dimension of said cylindrical space in accordance with the diameter of the coins to be stacked without causing separation of said overlapped blades; an operative member pivotably supported by one of said support flanges; a like plurality of adjusting pins extending from said operative member to engage said plurality of blades; and spring means slidably urging said blades inwardly along said support pins and said adjusting pins to retain said one edge of each blade overlapping onto said adjacent blade so that pivoting of said operative member causes pivoting of said blades to thereby adjust the internal cross-dimension of said cylindrical space.

2. A coin stacking tube device as claimed in claim 1 in which said spring means comprises a plurality of leaf springs, each leaf spring abutted against an edge of a respective one of said blades.

3. A coin stacking tube device comprising a first support flange; a plurality of parallelly-directed first support pins extending from said first support flange; a second support flange; a like plurality of parallelly-directed second support pins extending from said second support flange toward said first support pins; a like plurality of blades, each blade having a first blade end and a second blade end, said blades being pivotally supported on the first blade ends by said first support pins and on the second blade ends by said second support pins so that one edge of each blade overlaps onto an adjacent blade to form a tube wall defining internally a continuous cylindrical space of polygonal cross-section for stacking therein a predetermined number of coins, said blades being pivotable to permit adjustment of the internal cross dimension of said cylindrical space in accordance with the diameter of the coins to be stacked without causing separation of said overlapped blades, an operative member pivotably supported by one of said support flanges; a like plurality of adjusting pins extending from said operative member to engage said plurality of blades; and a plurality of leaf springs, each leaf spring abutted against an edge of a respective one of said blades to urge said blades inwardly along said support pins and said adjusting pins so that pivoting of said operative member causes pivoting of said blades to thereby adjust the internal cross-dimension of said cylindrical space.

* * * * *